United States Patent [19]

Saur et al.

[11] Patent Number: 4,986,443

[45] Date of Patent: Jan. 22, 1991

[54] METHOD OF DISCHARGING A SUBSTANCE FROM A CARTRIDGE AND AN APPARATUS FOR CARRYING OUT THE METHOD

[75] Inventors: Wolfgang Saur, Buttikon; Robert Tonolla, Thalwil, both of Switzerland; Franz Taschke, Stuttgart; Siegfried Staemmele, Winnenden, both of Fed. Rep. of Germany

[73] Assignee: Gurit-Essex AG, Switzerland

[21] Appl. No.: 376,312

[22] Filed: Jul. 6, 1989

[30] Foreign Application Priority Data

Jul. 13, 1988 [DE] Fed. Rep. of Germany ..... 3823708
Jul. 19, 1988 [CH] Switzerland ..... 2749/88

[51] Int. Cl.[5] ..... B67D 5/00

[52] U.S. Cl. ..... 222/1; 222/82; 222/137; 222/327

[58] Field of Search ..... 222/80–83, 222/83.5, 85–86, 89, 137, 145, 162, 325–327, 333, 389–390, 1

[56] References Cited

U.S. PATENT DOCUMENTS 3,130,872 4/1964 Myers et al. ..... 222/82
3,504,826 4/1970 Carlton ..... 222/389 X
3,527,389 9/1970 Farmer ..... 222/327
3,570,719 3/1971 Schiff ..... 222/137
4,067,479 1/1978 Moline ..... 222/94
4,432,765 2/1984 Oscarsson ..... 604/411
4,624,393 11/1986 Lopez ..... 222/835
4,690,306 9/1987 Staheli ..... 222/80
4,741,155 5/1988 McCarty ..... 222/82 X

*Primary Examiner*—Michael S. Huppert
*Attorney, Agent, or Firm*—Tarolli, Sundheim & Covell

[57] ABSTRACT

The invention provides a method and an apparatus for discharging a substance contained in a cartridge or the like from the cartridge. The substance is prevented from flowing out by a sealing member provided at the outlet of the cartridge. To open the cartridge, a relative displacement between the cartridge and a coupling member mounted on the connection piece of the cartridge is effected to thereby open the sealing member by way of a cutting member provided in the coupling member. The sealing member is opened at least to such an extent that it releases the flow path of the substance contained in the cartridge fully or partially due to the pressure exerted on the sealing member by the substance contained in the cartridge during an initial phase of the discharge operation.

15 Claims, 3 Drawing Sheets

METHOD OF DISCHARGING A SUBSTANCE FROM A CARTRIDGE AND AN APPARATUS FOR CARRYING OUT THE METHOD

BACKGROUND OF THE INVENTION

1. Field of the Invention

The present invention refers to a method of discharging a substance contained in a cartridge or the like from said cartridge. The substance in the cartridge is prevented from flowing out in the initial condition of the cartridge by a sealing member provided at the outlet of the cartridge.

Further, the present invention refers to an apparatus for dispensing a substance which must be stored in the absence of air. The apparatus comprises a cartridge containing said substance to be dispensed. The cartridge has an outlet opening covered by a sealing member and a piston member inserted into the cartridge at the end opposite to said outlet opening. The piston member sealingly closes the end opposite to said outlet opening and is slidably received in the interior of the cartridge. Means are provided for sliding the piston member into the cartridge to thereby exert a pressure on the substance contained in the cartridge.

2. Prior Art

Power-driven means for the application of multi-component substances are known in the art. Particularly, these means are used to apply a two-component adhesive material to two objects to be adhesively connected one to each other. The apparatus used for this purpose comprise two cartridges containing each a reactive component. The two components have to be mixed together to form the adhesive substance. Thus, ejection members are provided to discharge the content of each cartridge simultaneously to a mixing means in which they are thoroughly mixed whereby a chemical reaction between the two components starts. The adhesive substance prepared in this way is discharged through an outlet nozzle of the mixing means and applied onto the objects to be glued together.

According to the prior art, the cartridges containing the reactive substances are brought into operating condition and, thereafter, inserted into the apparatus. However, the discharging of the cartridges often presents difficulties. The cartridges are provided with a piston-like ejection member slidably mounted in the interior of the cartridge. Since the ejection member can not seal the interior of the cartridge perfectly, the cartridges are provided with a cover member in order to safely avoid atmospheric air from gaining access to the interior of the cartridge and, thereby, to the substance contained therein during storage of the cartridge. This measure must be taken because an unintended contact of the substance contained in the cartridge with atmospheric air could trigger an undesired preliminary chemical reaction of the substance contained in the cartridge.

Such a cover member, however, prevents or at least impedes the access to the piston-like ejection member.

The other end of the cartridge provided with an outlet opening must be sealed as well during storage of the cartridge in order to avoid access of atmospheric air to the content of the cartridge up to the moment when the cartridge is used. Thus, in order to prepare the apparatus for operation, it is not only necessary to insert the cartridges, usually two, into the apparatus, but also to open the cover at the end of the piston-like ejection member as well as the sealing at the outlet end of the cartridge. This proceeding is particularly difficult and cumbersome to perform in the case when the cartridges form a unit with the mixing means and the tubular means connecting the cartridges to the mixing means, ready to be inserted as a whole into the apparatus. In this case, the outlet openings of the cartridges provided with a sealing cover means are not accessible with the result that the cartridges have to be released from the associated connecting tube in order to enable an operator to remove the sealing cover means at the outlet opening. Consequently, the use of ready-to-use units, consisting of e.g. two cartridges, a mixer and two connection tubes connecting the two cartridges to the mixer, preferably in the form of units which can be disposed after use, was not possible. Such units, on the other hand, would be very practical, safe and time saving.

OBJECTS OF THE INVENTION

It is an object of the present invention to provide a method and an apparatus for discharging a substance contained in a sealed cartridge which avoids the disadvantages of the apparatus' of the prior art.

It is a further object of the present invention to provide a method and an apparatus for discharging a substance contained in a sealed cartridge which makes use of ready-to-use cartridge assemblies consisting of at least two cartridges, a mixing unit and tubular means connecting the cartridges to the mixing unit.

It is a further object of the present invention to provide a method and an apparatus for discharging a substance contained in a sealed cartridge which avoids the need to prepare the cartridges containing the reactive substance prior to use, particularly to avoid any step of opening the cartridges at the outlet end thereof and, eventually, at the operating end thereof.

SUMMARY OF THE INVENTION

To achieve these and other objects, the invention provides, according to a first aspect, a method of discharging a substance contained in a cartridge or the like from said cartridge. When the cartridge is in its initial condition, e.g. for storage thereof, the substance is prevented from flowing out by a sealing member provided at the outlet of the cartridge. In order to render the cartridge ready for use, a relative displacement between the cartridge and a coupling means mounted on the connection piece of the cartridge is effected to thereby open the sealing member by means of a cutting means provided in the coupling means at least to such an extent that the sealing member releases the flow path of the substance contained in the cartridge fully or partially due to the pressure exerted on the sealing member by the substance contained in the cartridge during an initial phase of the discharge operation. The relative displacement between the cartridge and the coupling means can be a linearly sliding motion of the cartridge with reference to the coupling means or a rotational motion of the cartridge with reference to the coupling means.

According to a second aspect, the invention provides an apparatus for dispensing a substance which must be stored in the absence of air. The apparatus of the invention comprises a cartridge containing the substance to be dispensed, said cartridge having an outlet opening covered by a sealing member and a piston member inserted into the cartridge at the end opposite to said outlet opening. The piston member sealingly closes the end opposite to said outlet opening and is slidably received in the interior of the cartridge.

Means are provided for sliding the piston member into the cartridge to thereby exert a pressure on the substance contained in the cartridge.

The cartridge comprises a connection piece provided at the outlet end and a coupling member mounted on the connection piece. The coupling member has an immersion chamber, a cutting member and a supporting member for the connection piece. The immersion chamber has a depth sufficient to enable the cartridge to be displaced with reference to the coupling member under the influence of a force exerted on the end opposite of the outlet of the cartridge to such an extent that the sealing member covering the outlet opening of the cartridge runs against the cutting member during the displacement of the cartridge. Thereby, it is cut open sufficiently such that the sealing member does not withstand the pressure of the substance any longer and reaches a position where a flow path for the substance is opened.

Further, the apparatus may comprise a dynamic mixing means having an outlet nozzle and two inlet apertures, each of said two inlet apertures being connected to the respective coupling member of two cartridges by means of tubular means.

The two cartridges, the mixing means and the tubular means thereby constitute a ready-to-use unit which can be inserted into the driving means and removed therefrom as a whole whereby the tubular members are inseparably, without destroying the unit, connected to the mixing means and the cartridges, respectively, and whereby each of the cartridges comprises at its outlet end and/or at its operating end a cover means automatically opening upon the action of a mechanical force provided by the driving means and acting on said cartridges.

Thus, a cumbersome preparing manipulation at the outlet end of the cartridges prior to the use of the cartridges is avoided. The result is that the cartridge assembly can be prepared during manufacturing to a ready-to-use condition inasmuch as the cartridges can be fixedly connected, by the tubular means, to the common mixing unit without the danger that the cartridges could be interchanged or that two identical cartridges are connected to the same mixing unit. The usual perforating of the sealing member at the outlet of the cartridge and/or the removal of a sealing cover at the opposite end is avoided. The cartridge is automatically opened under the influence of the driving force. For this purpose, particular sealing members are provided, preferably in the form of diaphragms which further can have a rated breaking portion.

BRIEF DESCRIPTION OF THE DRAWINGS

In the following, some preferred embodiments of the invention will be further explained, with reference to the accompanying drawings, in which.

DETAILED DESCRIPTION OF A PREFERRED EMBODIMENTS

Figure 1:
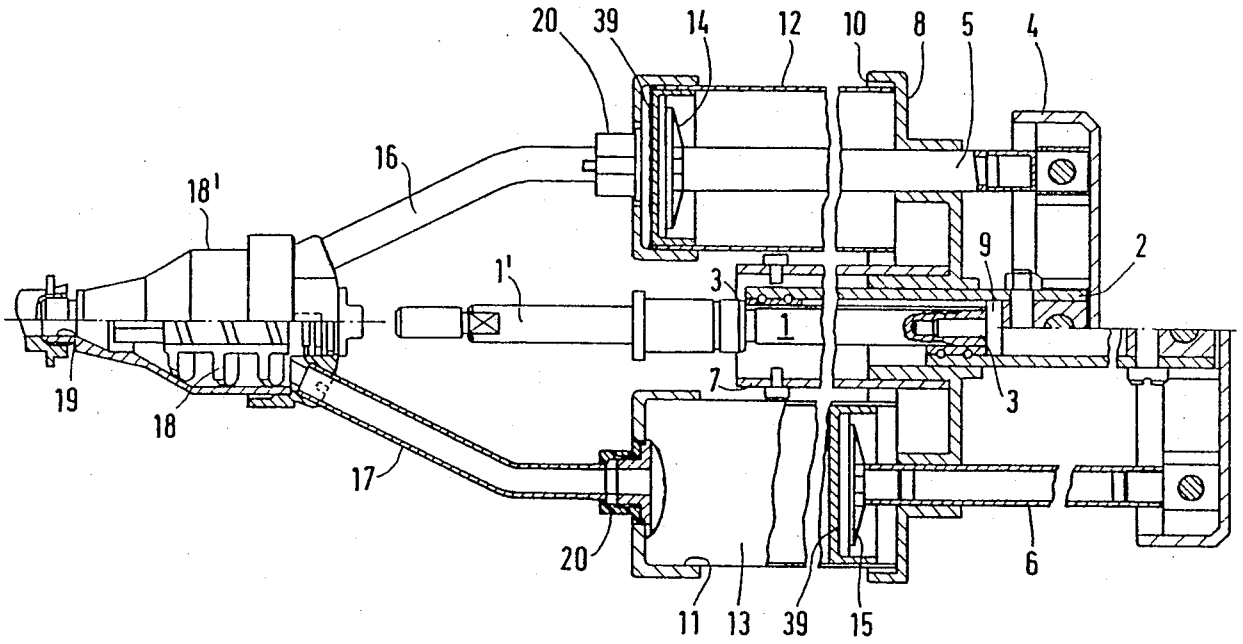
FIG. 1 shows a side view of a part of a dispensing apparatus and of a cartridge assembly of the invention, partially sectioned.

According to FIG. 1, the apparatus comprises a threaded spindle 1 which is rotatably mounted in a gear box housing not shown in the drawing. The spindle 1 is driven by an electro motor (not shown) and engages a carriage member 2 which comprises a spindle nut 3 received in the interior of the carriage member 2. For instance, the carriage member 2 may be constructed of a square or rectangular hollow profile material. A supporting member 4 is connected to the other end of the carriage member 2, said supporting member receiving the back ends of two pusher piston rods 5 and 6 which are arranged in parallel relationship to each other. The carriage member 2 may be displaced in axial direction by means of the threaded spindle 1 and the spindle nut 3. Particularly, the carriage member is displaced in the interior of a hollow longitudinal beam 7 made of a square or rectangular profile member incorporating a guiding member 8 for the two pusher piston rods 5 and 6 as well as for the carriage member 2. The back end surface of the threaded spindle 1 is provided with a stop member 9 against which the supporting member 4 abuts as soon as the carriage member 2 reaches its frontal end position.

The guiding member 8 cooperates with cartridge retaining members 10 and 11 adapted to receive two cartridges 12 and 13. The cartridges 12 and 13 contain the reactive components to be mixed together, for instance each cartridge containing one component of a two-component adhesive material. The apparatus further comprises two pusher members 14 and 15 mounted on the piston rods 5 and 6 and associated with the bottom or operating end of the cartridges 12 and 13.

The lower portion of FIG. 1 shows the cartridge 13 and the position of the apparatus prior to operation thereof. The pusher member 15 contacts the associated bottom portion of the cartridge 13 which may be in the form of a piston-like ejection member 39 slidably mounted in the interior of the cartridge 13. Thereby, the arrangement is such that each cartridge 12 and 13 is axially displaceable in the cartridge retaining means constituted by the guiding member 8 and the cartridge retaining members 10 and 11, respectively. The purpose of this design will be further explained hereinafter.

The cartridge retaining members 10 and 11 each comprise coupling members 20, these members 20 being connected to a common mixing unit 18 having a mixer head 18' and a discharge nozzle 19, by means of connecting tubes 16 and 17.

Upon a linear displacement of the pusher members 14 and 15 towards the cartridges 12 and 13, the content thereof will be fed to the mixing unit 18 via the connecting tubes 16 and 17 as will be further explained in detail hereinafter. The lower portion of FIG. 1 shows the pusher member 15 in its initial position, the cartridge 13 being full, while the upper portion of FIG. 1 shows the pusher member 14 in its advanced position after the content of the cartridge 12 having been discharged and pressed through the connecting tube 16 into the mixing unit 18.

According to the embodiment shown in the drawings, a connection between the tubes 16 and 17 and the associated coupling members 20 is realized which can not be released by the operator without destroying the cartridge assembly. The same is true for the connection between the tubes 16 and 17 and the common mixing unit 18; consequently, the mixing unit 18 with its mixer head 18', the connecting tubes 16 and 17 with their coupling members 20, as well as the cartridges 12 and 13 form a compact cartridge assembly unit which can be replaced only as a whole.

Furthermore, it must be noted that a shaft part 1' is provided to drive the mixing unit 18. The shaft part 1' is connected to the threaded spindle 1 such that the mixing unit 18 is driven simultaneously with the movement of the carriage member 2 via the spindle nut 3.

Figure 2:
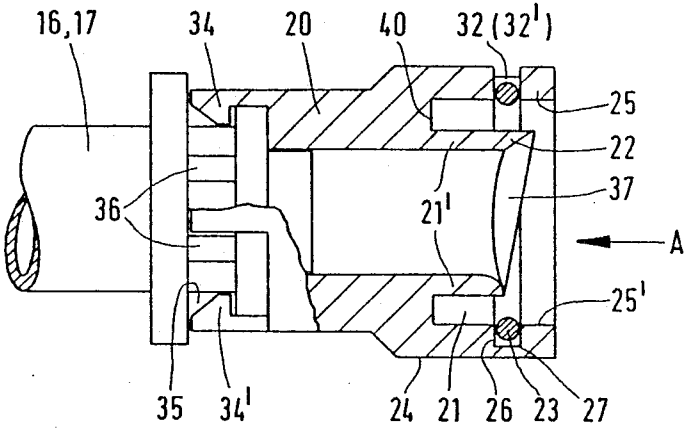
FIG. 2 shows an axially sectioned view of a coupling member in a larger scale.
Figure 3:
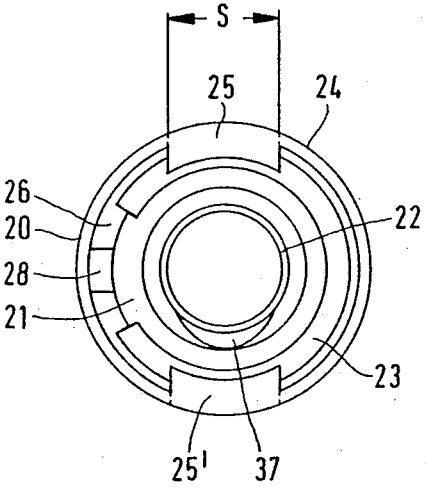
FIG. 3 shows a view in the direction of arrow A of FIG. 2.

FIGS. 2 and 3 show the design of the coupling members 20 in more detail. The coupling member 20 preferably has tubular shape and is made of plastic material. It comprises an annular groove provided in one of its frontal surfaces serving as a immersion chamber 21. The inner wall 21' delimiting the immersion chamber 21 is obliquely cut with regard to the axis of the tubular coupling member and designed as a cutting element 22, having a cutting edge 37. The outer wall 24 of the immersion chamber 21 projects outwardly over the inner wall 21' and is provided with cam-like protrusions 25 and 25', respectively, arranged diametrically opposite to each other and delimiting a further groove 27 in which an annular fixing member 23 is received. Preferably, the fixing member 23 is constituted by a spring washer whereby the cam-like protrusions 25, 25' prevent an axial displacement of the fixing member 23. Furthermore, the groove 27 is delimited by a collar-shaped stop surface 26.

As can be seen from FIG. 3, the cam-like protrusions 25, 25' extend in circumferential direction over the distance S whereby a lug 28 prevents the spring washer from a rotation and, simultaneously, protects it against falling out. In order to enable the spring washer to radially escape outwardly during the mounting of the coupling member 20 on the outlet flange 30 and 31, respectively, of the cartridges, slit-shaped apertures 32, 32' are provided in the wall of the coupling member 20 located behind the cam-like protrusions 25, 25', the dimensions of the apertures 32, 32' in circumferential direction substantially corresponding to the ones of the cam-like protrusions 25, 25'. Thus, the fixing member 23 can escape into these apertures 22, 22' if it is resiliently deformed in radial direction. When the coupling members 20 are connected to the outlet flange 30 and 31, respectively, the fixing member 23 engages a circumferential groove 33 provided in the outer surface of the outlet flanges 30 and 31, respectively (cf. FIG. 5).

Figure 4:
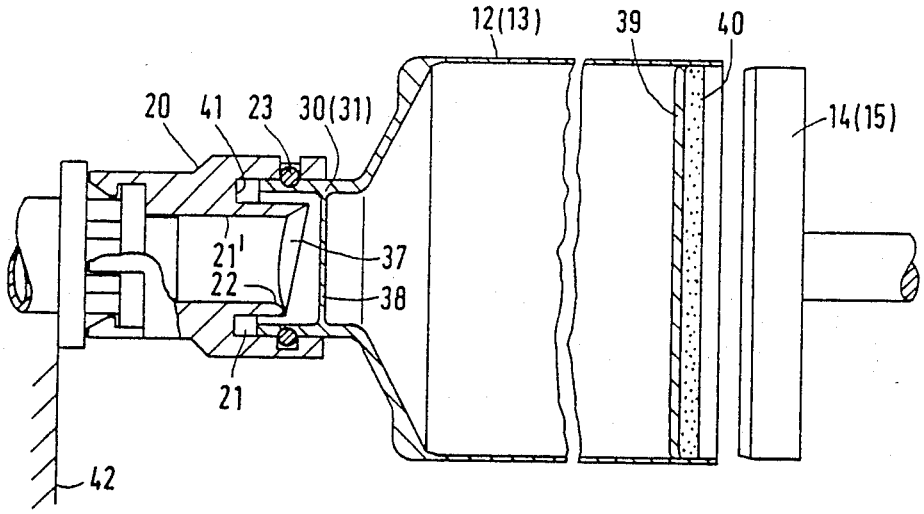
FIG. 4 shows a coupling member and a cartridge connected thereto as well as an ejection piston, essentially in an axially sectioned view.
Figure 5:
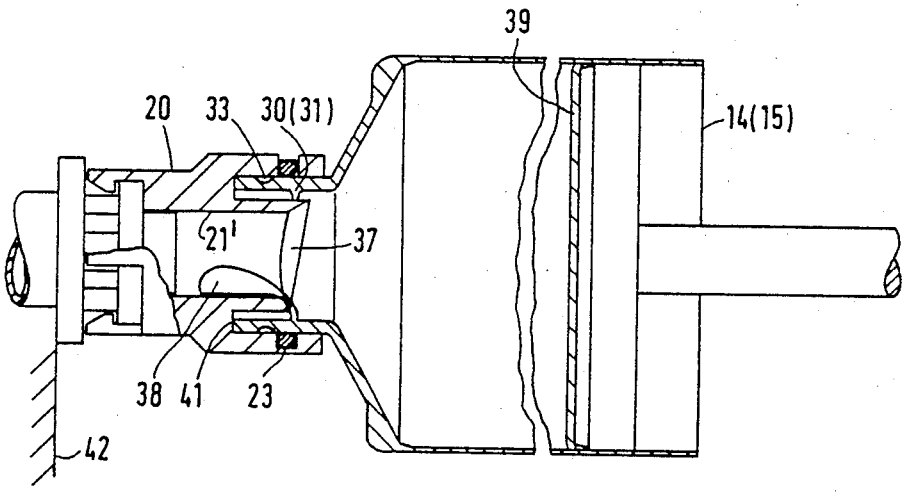
FIG. 5 shows a similar view as FIG. 4, but with the ejection piston moved forward.

The connection of the coupling members 20 with the associated connecting tubes 16 or 17 is illustrated in FIGS. 2, 4 and 5; in the following, reference is made to FIG. 2. The coupling member 20 is provided with resilient tongues 34 at the end directed towards the connecting tubes 16 and 17, respectively. The tongues 34 comprise latches 34' projecting radially inwards in which, the tubes 16 and 17, respectively, being connected to the coupling member 20, engage a circumferential groove 35 provided at the ends of the connecting tubes 16 and 17. The coupling member is protected against rotation by means of two stop members 36 provided in the circumferential groove 35.

According to FIGS. 4 and 5, a cartridge 12 and 13, respectively, is illustrated which comprises a sealing diaphragm 38 located in the region of the outlet flange 30 and 31, respectively. Thereby, the arrangement is such that the cartridge 12 shown in FIG. 4 is somewhat movable in axial direction in its initial position where it is protected by the fixing member 23. This is possible because some space remains in the receiving chamber 21 adapted to receive the flange 30 and 31, respectively.

If the threaded spindle 1 is rotated, the mixing unit 18 is driven by the shaft part 1' and, simultaneously, the pusher members 14 and 15 contact the axially movable ejection member 39 of the cartridges 12 and 13 or the diaphragm 40 arranged in front of the ejection member 39 whereby the diaphragm is destroyed. A moisture absorbent substance (a desiccant) can be provided between the diaphragm 40 and the ejection member 39.

Simultaneously, each of the cartridges 12 and 13 is axially displaced relative to the fixed coupling members 20 after the fixing members 23 having been radially extended. Upon this axial displacement movement of the cartridges 12 and 13, the sealing diaphragm 38 in the outlet flange 30, 31 is cut open by means of the cutting blade 37 of the cutting member 22. This situation is illustrated in FIG. 5. Thereby, the annular bottom 41 of the immersion chamber 21 of the coupling member constitutes a stop means for the axial displacement of the cartridge. The sealing diaphragm 38 is bent in a hinge-like manner toward the interior wall of the coupling member 20, under the influence of the pressure of the reactive component discharged from the cartridge, such that the passage through the outlet flange 30 is almost fully opened and with the result that the substance contained in the cartridge can be pressed out without problems. The length of the cutting blade 37 in circumferential direction as well as its design has to be chosen according to the particular circumstances; however, it has proven advantageous that the cutting blade extends over an angle of about 60° to 100° in circumferential direction.

During the discharge step, the coupling member 20 rests on a frame part 42 shown in FIGS. 4 and 5; thus, the coupling member 20 is fixed and can not be displaced together with the associated cartridge.

According to the embodiment just hereinbefore described and shown in the drawings, the cartridge 12 is provided with a sealing diaphragm 38 located in the outlet flange 30 and ensuring an air-tight sealing of the interior of the cartridge 12. The opening of the diaphragm 38 was performed by an axial displacement of the cartridge 12 towards the cutting element 22 which is incorporated in the interior of the coupling member 20.

What we claim is:

1. A method for discharging a first substance contained in a first cartridge or the like from the first cartridge and a second substance contained in a second cartridge or the like from the second cartridge and for discharging a mixture of the first and second substances, the first substance being prevented from flowing out in the initial condition of the first cartridge by a first sealing member provided at the outlet of the first cartridge, the second substance being prevented from flowing out in the initial condition of the second cartridge by a second sealing member provided at the outlet of the second cartridge, said method comprising the steps of:

effecting a relative displacement between the first cartridge and a first coupling means mounted on a connection piece of the first cartridge;

effecting a relative displacement between the second cartridge and a second coupling means mounted on a connection piece of the second cartridge;

opening the first sealing member by means of a first cutting means provided in the first coupling means;

opening the second sealing member by means of a second cutting means provided in the second coupling means;

releasing the flow path of the first substance contained in the first cartridge due to the pressure exerted on the first sealing member by the first substance contained in the first cartridge during an initial phase of the discharge operation;

releasing the flow path of the second substance contained in the second cartridge due to the pressure exerted on the second sealing member by the second substance contained in the second cartridge during an initial phase of the discharge operation;

mixing the discharged first substance from the first cartridge and the discharged second substance from the second cartridge; and discharging the mixture of the discharged first and second substances.

2. A method according to claim 1 in which the relative displacement between the first cartridge and the first coupling means is a linearly sliding motion of the first cartridge with reference to the first coupling means.

3. A method according to claim 2 in which the relative displacement between the second cartridge and the second coupling means is a linearly sliding motion of the second cartridge with reference to the second coupling means.

4. An apparatus for dispensing a substance which must be stored in the absence of air comprising:

a cartridge containing said substance to be dispensed, said cartridge having an outlet opening covered by a sealing member and a piston member inserted into the cartridge at the end opposite to said outlet opening, said piston member sealingly closing said end opposite to said outlet opening and being slidably received in the interior of the cartridge;

means for sliding said piston member into the cartridge to thereby exert a pressure on said substance contained in the cartridge;

said cartridge comprising a connection piece provided at said outlet end and a coupling member mounted on said connection piece, said coupling member having an inner wall portion and an outer wall portion, said inner and outer wall portions defining an immersion chamber, said coupling member including a cutting member and a supporting member for said connection piece, said immersion chamber having a depth sufficient to enable the cartridge to be displaced with reference to said coupling member under the influence of a force exerted on said end opposite of said outlet of the cartridge to such an extent that said sealing member covering said outlet opening of the cartridge runs against said cutting member during said displacement of the cartridge and is cut open sufficiently such that said sealing member does not withstand the pressure of the substance any longer and reaches a position where a flow path for said substance is opened.

5. An apparatus according to claim 4 in which said sealing member is a diaphragm.

6. An apparatus according to claim 5 in which said diaphragm comprises a rated breaking portion.

7. An apparatus according to claim 6 in which said rated breaking portion is constituted by a groove having the shape of a circular arc.

8. An apparatus according to claims 4 and 5 in which said cutting member is a hollow cutting pin having such shape and dimensions that said diaphragm remains mechanically fixed to the wall of said connection piece of said cartridge in a limited area, said still fixed area constituting a hinge-like pivot for said diaphragm which is displaced towards the inner wall of said hollow cutting pin under the influence of the substance discharged from said cartridge.

9. An apparatus according to claim 8 in which said hollow cutting pin comprises a cutting edge running obliquely with regard to a plane extending perpendicularly to the longitudinal axis of said cartridge, the slanting angle being positive or negative.

10. An apparatus according to claim 4 in which said coupling member comprises at its frontal surface facing the cartridge at least two cam-shaped tongues which are offset to each other in circumferential direction, said tongues extending radially inwards, along a limited angle in circumferential direction and axially backwards to such an extent that they delimit together with a collar-shaped abutment face in the interior of the wall of said coupling member, receiving groove portions for a holding member constituted by a spring washer, the wall of said coupling member comprising apertures located behind said cam-shaped tongues allowing a deformation of said spring washer in radial direction.

11. An apparatus according to claim 10 further comprising tubular means adapted to be connected to said coupling member of the cartridge, said tubular means having a circumferential groove, and in which said coupling member further comprises resilient tongue means equipped with latching projections which snappingly engage said circumferential groove in said tubular means when said tubular means is connected to said coupling member.

12. An apparatus according to claim 11 in which said coupling member and said tubular means is protected against rotation by means of stop means provided in said circumferential groove of said tubular means.

13. An apparatus for dispensing a substance which must be stored in the absence of air comprising:

a cartridge containing said substance to be dispersed, said cartridge having an outlet opening covered by a sealing member and a piston member inserted into the cartridge at the end opposite to said outlet opening, said piston member sealingly closing said end opposite to said outlet opening and being slidably received in the interior of the cartridge;

means for sliding said piston member into the cartridge to thereby exert a pressure on said substance contained in the cartridge;

said cartridge comprising a connection piece provided at said outlet end and a coupling member mounted on said connection piece, said coupling member having an inner wall and an outer wall portion, said inner and outer wall portions defining an immersion chamber, said coupling member including a cutting member and a supporting member for said connection piece, said immersion chamber having a depth sufficient to enable the cartridge to be displaced with reference to said coupling member under the influence of a force exerted on said end opposite of said outlet of the cartridge to such an extent that said sealing member covering said outlet opening of the cartridge runs against said cutting member during said displacement of the cartridge and is cut open sufficiently such that said sealing member does not withstand the pressure of the substance any longer and reaches a position where a flow path for said substance is opened;

a dynamic mixing means having an outlet nozzle and two inlet apertures, each of said two inlet apertures being connected to the respective coupling member of two cartridges by means of tubular means.

14. An apparatus according to claim 13 in which said means for sliding said piston member in the cartridge is constituted by a driving motor having a gear box whereby said dynamic mixing means is driven by said driving motor via said gearbox.

15. An apparatus according to claim 4 in which said piston member is covered by a diaphragm which is destroyed when said means for sliding said piston member into the cartridge runs thereagainst, and in which the space between said diaphragm and said piston member is filled with a desiccant.

* * * * *